US008795062B2

(12) United States Patent
Bennett

(10) Patent No.: US 8,795,062 B2
(45) Date of Patent: Aug. 5, 2014

(54) GAMING SYSTEM, A GROUP GAME CONTROLLER, A METHOD OF DISPLAYING AN OUTCOME OF A GROUP GAME AND A GROUP GAME DISPLAY

(75) Inventor: Nicholas Luke Bennett, Manley Vale (AU)

(73) Assignee: Aristocrat Technologies Pty Limited, North Ryde (AU)

( * ) Notice: Subject to any disclaimer, the term of this patent is extended or adjusted under 35 U.S.C. 154(b) by 1270 days.

(21) Appl. No.: 12/198,509

(22) Filed: Aug. 26, 2008

(65) Prior Publication Data

US 2009/0191942 A1 Jul. 30, 2009

(30) Foreign Application Priority Data

Aug. 27, 2007 (AU) ..... 2007904618

(51) Int. Cl.
*A63F 9/24* (2006.01)
*G07F 17/32* (2006.01)

(52) U.S. Cl.
CPC ..... *G07F 17/3213* (2013.01); *G07F 17/32* (2013.01); *G07F 17/3288* (2013.01); *G07F 17/3211* (2013.01)
USPC ..... 463/25; 463/26; 463/30; 463/31; 463/32; 463/36; 463/42

(58) Field of Classification Search
CPC .. G07F 17/3213; G07F 17/32; G07F 17/3288
USPC ..... 463/25, 26, 30–32, 36, 42
See application file for complete search history.

(56) References Cited

U.S. PATENT DOCUMENTS

| | | | | |
|---|---|---|---|---|
| 6,210,275 | B1 * | 4/2001 | Olsen | 463/16 |
| D536,743 | S | 2/2007 | Kaminkow et al. | |
| D537,886 | S | 3/2007 | Kaminkow et al. | |
| 2003/0100361 | A1 | 5/2003 | Sharpless et al. | |
| 2004/0102243 | A1 * | 5/2004 | Olsen | 463/25 |
| 2004/0214630 | A1 * | 10/2004 | Mayeroff | 463/20 |
| 2006/0046822 | A1 | 3/2006 | Kaminkow et al. | |
| 2006/0046823 | A1 | 3/2006 | Kaminkow et al. | |
| 2006/0229122 | A1 | 10/2006 | Macke | |
| 2007/0002060 | A1 | 1/2007 | King | |
| 2007/0004513 | A1 | 1/2007 | Wells et al. | |
| 2007/0049368 | A1 | 3/2007 | Kuhn et al. | |
| 2007/0060292 | A1 | 3/2007 | Peterson | |
| 2007/0077985 | A1 | 4/2007 | Walker et al. | |
| 2007/0097016 | A1 | 5/2007 | McGowan | |
| 2007/0117603 | A1 * | 5/2007 | Seelig et al. | 463/16 |
| 2007/0149292 | A1 | 6/2007 | Kaminkow et al. | |
| 2007/0155463 | A1 * | 7/2007 | Ghaly | 463/16 |

FOREIGN PATENT DOCUMENTS

| | | | |
|---|---|---|---|
| AU | 2005200902 | A1 | 9/2005 |
| CA | 2530329 | | 6/2007 |

(Continued)

*Primary Examiner* — Dmitry Suhol
*Assistant Examiner* — Andrew Kim
(74) *Attorney, Agent, or Firm* — Hanley, Flight & Zimmerman, LLC

(57) ABSTRACT

A gaming system comprising: a plurality of gaming devices; a common physical group game display comprising a an object arranged to travel on a path relative to the plurality of gaming devices; and a group game controller in data communication with the plurality of gaming devices and the group game display, the group game controller configured to: determine a game outcome of a group game; and control movement of the object relative to the plurality of gaming devices based on the game outcome.

23 Claims, 8 Drawing Sheets

(56) References Cited

FOREIGN PATENT DOCUMENTS

| | | | |
|---|---|---|---|
| CN | 1842827 | | 10/2006 |
| JP | 09108431 A | * | 4/1997 |
| WO | 2006028740 A2 | | 3/2006 |
| WO | WO2006028740 | | 3/2006 |
| WO | WO2007016035 | | 2/2007 |
| WO | WO2007075401 | | 7/2007 |
| WO | WO2007075582 | | 7/2007 |

* cited by examiner

GAMING SYSTEM, A GROUP GAME CONTROLLER, A METHOD OF DISPLAYING AN OUTCOME OF A GROUP GAME AND A GROUP GAME DISPLAY

CROSS-REFERENCE TO RELATED APPLICATIONS

The present application claims the benefit of priority to Australian Provisional Patent Application No. 2007904618, filed on Aug. 27, 2007, entitled "A GAMING SYSTEM, A GROUP GAME CONTROLLER, A METHOD OF DISPLAYING AN OUTCOME OF A GROUP GAME AND A GROUP GAME DISPLAY", which is herein incorporated by reference in its entirety.

FIELD

The presently described technology relates to a gaming system, a group game controller, a method of displaying a group outcome and a group game display for a gaming system.

BACKGROUND

It is known to arrange gaming machines so that players can participate in group games. Such a group game is common to a plurality of gaming machines typically arranged in a bank next to one another. One or more of the players may trigger the group game. The group game may be played on a common display, typically a large screen video display, arranged above the gaming machines.

There is a need for an alternative technique that can be used in the display of a group game.

SUMMARY OF THE INVENTION

In a first aspect the invention provides a gaming system including:

a plurality of gaming devices;

a common physical group game display including a an object arranged to travel on a path relative to the plurality of gaming devices; and a group game controller in data communication with the plurality of gaming devices and the group game display, the group game controller configured to:

determine a game outcome of a group game; and control movement of the object relative to the plurality of gaming devices based on the game outcome.

In an embodiment the group game controller controls a stopping position of the object based on the game outcome.

In an embodiment the group game controller determines a participation in the group game of each of the plurality of gaming devices, and controls movement of the object based on the determined participation.

In an embodiment, the stopping position of at least a portion of the object relative to one or more of the gaming devices indicates the game outcome.

In an embodiment, the object is a vehicle.

In an embodiment, the vehicle is a train including at least one item of rolling stock and the position of at least one item of rolling stock indicates the game outcome.

In an embodiment the game outcome involves the award of a prize to a participating gaming device and at least one item of rolling stock is stopped at a prize indicating position relative to the gaming device.

In an embodiment, the group game controller determines a game outcome at least in part by determining a stopping position for the object.

In an embodiment, there are a plurality of items of rolling stock and the front of the first item of rolling stock and the rear of the item of rolling stock are separated from one another by a gap corresponding to a width of at least one gaming device, such that the train is not continuous.

In an embodiment, the gaming system includes track on which the train runs.

In an embodiment, at least a portion of the object carries a display for displaying a prize amount.

In an embodiment, the group game controller determines a group game outcome at least partly based on data received from one of the gaming devices indicating at least that the gaming device is entitled to win the group game.

In a second aspect, the invention provides a group game controller in data communication with a plurality of gaming devices and a physical group game display including an object arranged to travel on a path relative to the plurality of gaming devices, the group game controller configured to:

determine an outcome of a group game; and control movement of the object relative to the plurality of gaming devices based on the group game outcome.

In an embodiment, the group game controller is configured to control a stopping position of the object based on the game outcome.

In an embodiment, the group game controller is arranged to determine a participation in the group game of each of the plurality of gaming devices, and controls movement of the object based on the determined participation.

In an embodiment, the group game controller is arranged to determine a game outcome at least in part by determining a stopping position for the object.

In an embodiment, the group game controller is arranged to determine a group game outcome at least partly based on data received from one of the gaming devices indicating at least that the gaming device is entitled to win the group game.

In a third aspect, the invention provides a method of displaying an outcome of a group game including:

providing a common physical group game display including an object arranged to travel on a path relative to the plurality of gaming devices;

determining an outcome of a group game; and controlling movement of the object relative to the plurality of gaming devices based on the group game outcome.

In an embodiment, the method includes controlling a stopping position of the object based on the game outcome.

In an embodiment, the method includes determining a participation in the group game of each of the plurality of gaming devices, and controlling movement of the object based on the determined participation.

In an embodiment, the method includes indicating the game outcome by the stopping position of at least a portion of the object relative to one or more of the gaming devices.

In an embodiment, the method includes determining a game outcome at least in part by determining a stopping position for the object.

In an embodiment the method includes determining a group game outcome at least partly based on data received from one of the gaming devices indicating at least that the gaming device is entitled to win the group game.

In a fourth aspect the invention provides a group game display for a gaming system including a plurality of gaming devices, the group game display including a controllable object physically moveable along a path relative to the plurality of gaming devices to indicate a group game outcome.

In an embodiment, the object is a vehicle.

In an embodiment, the vehicle is a train including at least one item of rolling stock and the position of at least one item of rolling stock indicates the game outcome.

In an embodiment there are a plurality of items of rolling stock and the front of the first item of rolling stock and the rear of the item of rolling stock are separated from one another by a gap corresponding to a width of at least one gaming device, such that the train is not continuous.

In an embodiment, the group game display includes track on which the train runs.

In an embodiment, at least a portion of the object carries a display for displaying a prize amount.

In a fifth aspect, the invention provides a gaming system including:

a plurality of gaming devices which may participate in a group game; and a group game display arranged to display an object moving relative to the plurality of gaming devices during at least part of the group game, the display of the object being such that the object is not continuously displayed at least one gaming device.

In an embodiment a front of the object and a rear of the object are separated from one another by a gap.

In an embodiment, the gap corresponds to a width of a cabinet of at least one gaming device of the plurality of gaming devices.

In an embodiment, the group game display is a physical display.

In an embodiment, the group game display includes at least one video display.

In an embodiment, the gaming system includes a group game controller in data communication with the plurality of gaming devices and the group game display, the group game controller configured to:

determine an outcome of a group game; and control movement of the object relative to the plurality of gaming devices based on the group game outcome.

In an embodiment, the object is a train.

In a sixth aspect the invention provides a group game display for a gaming system including a plurality of gaming devices, the group game display arranged to display an object moving relative to the plurality of gaming devices during at least part of a group game, the display of the object being such that the object is not continuously displayed at least one gaming device.

In an embodiment, a front of the object and a rear of the object are separated from one another by a gap.

In an embodiment, the gap corresponds to a width of a cabinet of at least one gaming device of the plurality of gaming devices.

In an embodiment, the group game display is a physical display.

In an embodiment, the group game display includes at least one video display.

In an embodiment, the object is a train.

In a seventh aspect, the invention provides a method of gaming including providing a group game display arranged to display an object moving relative to the plurality of gaming devices during at least part of a group game, the display of the object being such that the object is not continuously displayed at least one gaming device.

In an embodiment, the method includes:

determining an outcome of a group game; and controlling movement of the object relative to the plurality of gaming devices based on the group game outcome.

In an eighth aspect, the invention provides a gaming system including:

a plurality of gaming devices which may participate in a group game; and a group game display including one or more video displays arranged to display an object moving relative to the plurality of gaming devices during at least part of the group game, the group game display controllable to display an alternate display element to instead of at least part of the object at least one gaming device.

In an embodiment, the object has a plurality of sub-objects and the alternate display element is displayed instead of at least part of one sub-object.

In an embodiment, the group game display includes a display of each of the gaming devices.

In an embodiment, the gaming system includes a group game controller in data communication with the plurality of gaming devices and the group game display, the group game controller configured to:

determine an outcome of a group game;

control movement of the object relative to the plurality of gaming devices based on the group game outcome; and control the display to display an alternate element instead of at least part of the object at least one gaming device.

In an embodiment, the group game controller is arranged to control the display to display an alternative element in relation to at least one ineligible gaming device.

In a ninth aspect, the invention provides a group game controller in data communication with a plurality of gaming devices and a group game display including one or more video displays, the group game controller configured to:

determine an outcome of a group game;

control movement of the object on the group game display relative to the plurality of gaming devices based on the group game outcome; and control the group game display to display an alternate element instead of at least part of the object at least one gaming device.

In an embodiment the group game controller is arranged to control the display to display an alternative element in relation to at least one ineligible gaming device.

In an embodiment, the object has a plurality of sub-objects and the alternate display element is displayed instead of at least part of one sub-object.

In an embodiment, the group game display includes a display of each of the gaming devices.

In a tenth aspect the invention provides a method of gaming including:

providing a group game display including one or more video displays;

determining an outcome of a group game;

controlling movement of an object on the group game display relative to the plurality of gaming devices based on the group game outcome; and controlling the group game display to display an alternate element instead of at least part of the object at least one gaming device.

In an embodiment, the object has a plurality of sub-objects and the alternate display element is displayed instead of at least part of one sub-object.

In an embodiment the method includes controlling the display to display an alternative element in relation to at least one ineligible gaming device.

In an eleventh aspect, the invention provides a gaming system including:

a plurality of gaming devices, each gaming device including a video display employed in a group game;

a group game controller in data communication with the gaming devices, the group game controller arranged to:

control the video displays of the gaming devices to provide a group game display during a group game in which sub-objects of an object are displayed as moving relative to the gaming devices;

determine a game outcome; and when the game outcome includes a winning outcome for a winning gaming device, control display of the object such that a sub-object corresponding to the winning outcome stops within the video display of the winning gaming device.

In an embodiment, the object is a train and the sub-objects are items of rolling stock.

In an embodiment, the object is a carousel and the sub-objects are respective ones of a plurality of carousel horses.

In an embodiment, the group game controller controls movement of the sub-objects so that they are displayed as rotating relative to the plurality of gaming devices.

In an embodiment, the group game controller controls movement of the sub-objects so that they move in a pattern relative to the plurality of gaming devices.

In a twelfth aspect, the invention provides a group game controller for a gaming system including a plurality of gaming devices, each gaming device including a video display employed in a group game, the group game controller arranged to:

control the video displays to provide a group game display during a group game in which sub-objects of an object are displayed as moving relative to the gaming devices;

determine a game outcome; and when the game outcome includes a winning outcome for a winning gaming device, control display of the object such that a sub-object corresponding to the winning outcome stops within the video display of the winning gaming device.

In an embodiment, the group game controller is arranged to control movement of the sub-objects so that they are displayed as rotating relative to the plurality of gaming devices.

In an embodiment, the group game controller is arranged to control movement of the sub-objects so that they move in a pattern relative to the plurality of gaming devices.

In a thirteenth aspect, the invention provides a method of gaming in a gaming system including a plurality of gaming devices, each gaming device including a video display employed in a group game, the method including:

controlling the video displays to provide a group game display during a group game in which sub-objects of an object are displayed as moving relative to the gaming devices;

determining a game outcome; and when the game outcome includes a winning outcome for a winning gaming device, controlling display of the object such that a sub-object corresponding to the winning outcome stops within the video display of the winning gaming device.

In an embodiment the method includes controlling movement of the sub-objects so that they are displayed as rotating relative to the plurality of gaming devices.

In an embodiment, the method includes controlling movement of the sub-objects so that they move in a pattern relative to the plurality of gaming devices.

BRIEF DESCRIPTION OF DRAWINGS

Exemplary embodiments of the invention are described in relation to the accompanying drawings, in which.

Figure 1A:
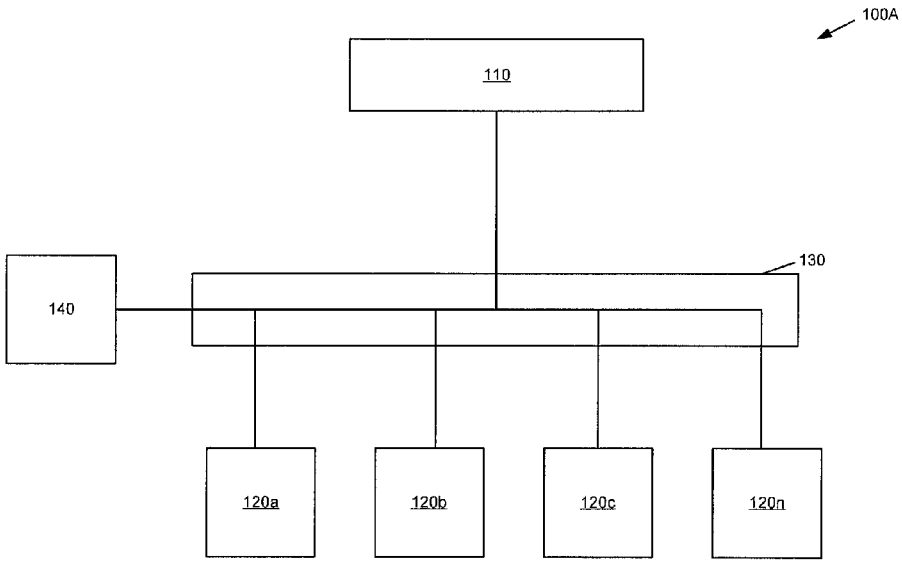
FIG. 1A is a block diagram of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Referring to the drawings, there is shown a gaming system arranged to implement a group game display in relation to a group game in which a plurality of gaming machines may participate. The group game display of certain embodiments of the present invention may be provided in a number of different forms depending on the specific embodiment, including a physical display, a video display independent of the gaming devices and by employing video displays that form part of the gaming devices.

General System Configuration

There are two general classes of gaming systems that are employed to carry out certain embodiments of the present invention. A first gaming system configuration 100A, is shown in FIG. 1A where a group game controller 110 is in data communication with a plurality of gaming devices 120 over a network 130. Four gaming devices are shown in FIG. 1A, however, a person skilled in the art will appreciate that the number of gaming devices can be varied. The gaming system configuration 100A employs a group game display 140 which independent of the gaming machines and is also in data communication with the group game controller over the network 130. Depending on the embodiment, the group game display 140 may be a physical display or a video display. A person skilled in the art will all appreciate that such embodiments will have the gaming devices 120 located in sufficiently close proximity that can view the common display 140. Note that where the common display 140 is a video display, this maybe provided by a plurality of video displays.

Figure 1B:
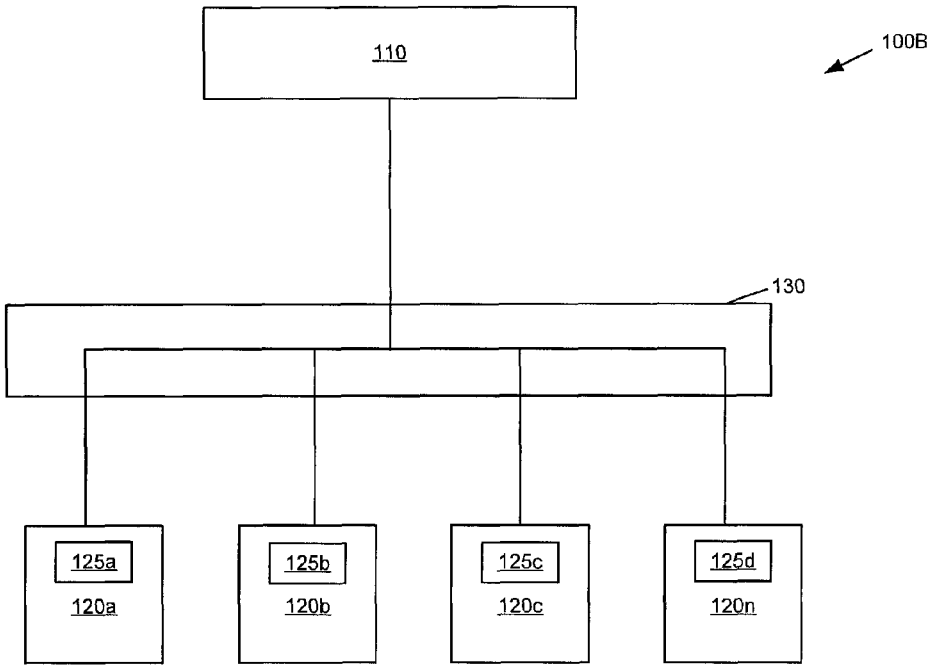
FIG. 1B is a block diagram of a gaming system.

The second configuration of a gaming system 100B is shown in FIG. 1B. In this embodiment, again a plurality of gaming devices 120 are connected via a network 130 to a group game controller 110. However, in this embodiment the group game display is provided by individual displays 125 associated with respective ones of the gaming devices. Typically such a display 125 will be provided by a display of the top box, main screen or player tracking device of the gaming device, and most advantageously by the top boxes.

A person skilled in the art will appreciate that other components may form part of the gaming system 100 of FIGS. 1A and 1B, for example, jackpot servers and the like. Further, depending on the specific architecture, parts of the games executed by the gaming devices 120 could be executed on a server together with the group game controller 110. Accordingly, FIGS. 1A and 1B are intended to reflect the logical relationship between the group game controller 110 and the gaming devices 120. A person skilled in the art will also appreciate that other configurations may be viable. For example, the gaming machines could be connected in a peer-to-peer arrangement with the group game controller executed by one of the gaming devices.

Gaming Devices

Herein, the term gaming device is used to refer to any device used by a player to a play a game and specifically includes stand alone gaming machines and interactive video terminals which implement games in a client/server architecture.

Figure 2:
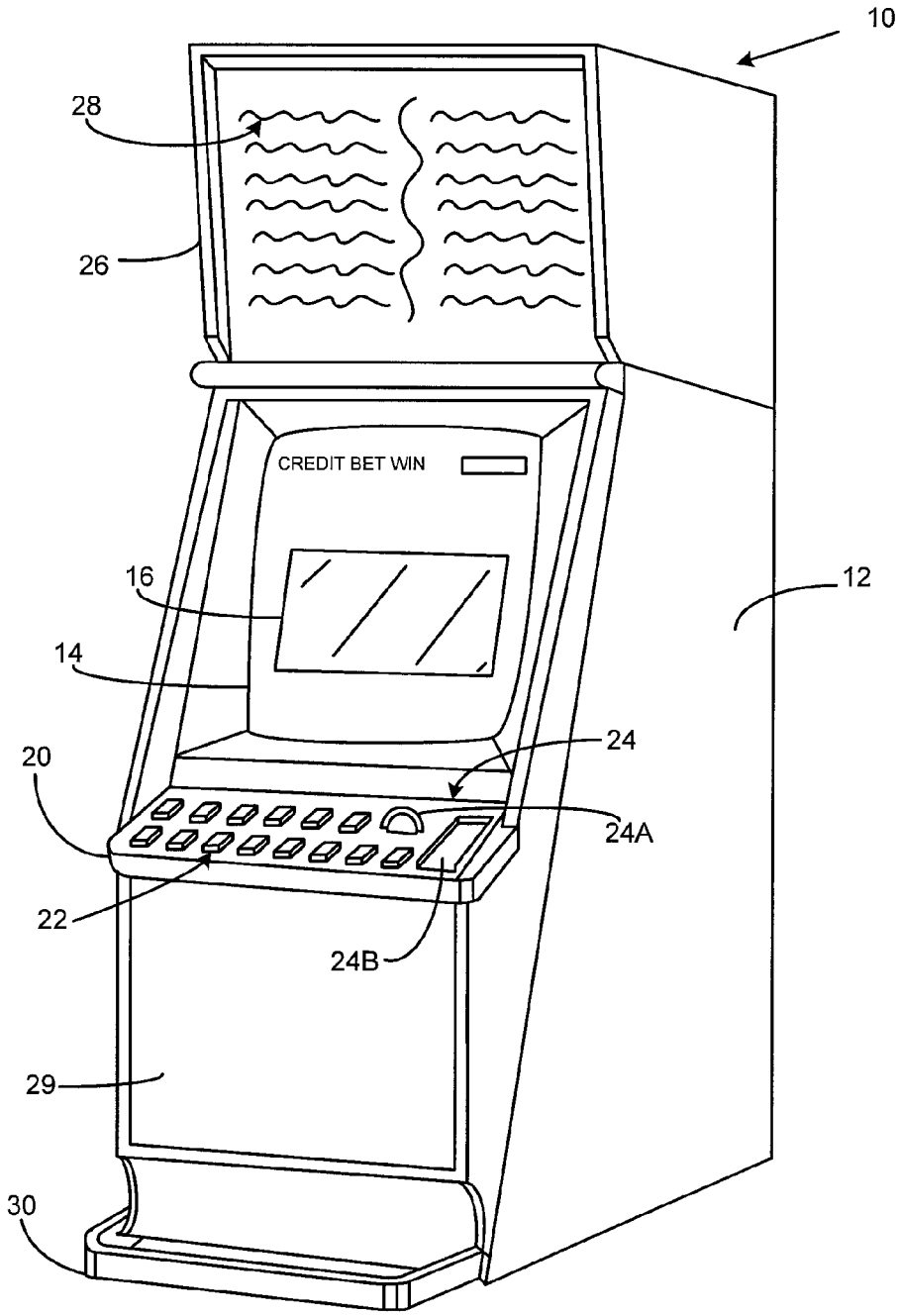
FIG. 2 is a perspective view of a gaming device in the form of a stand alone gaming machine.

A gaming device in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module including a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of group awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
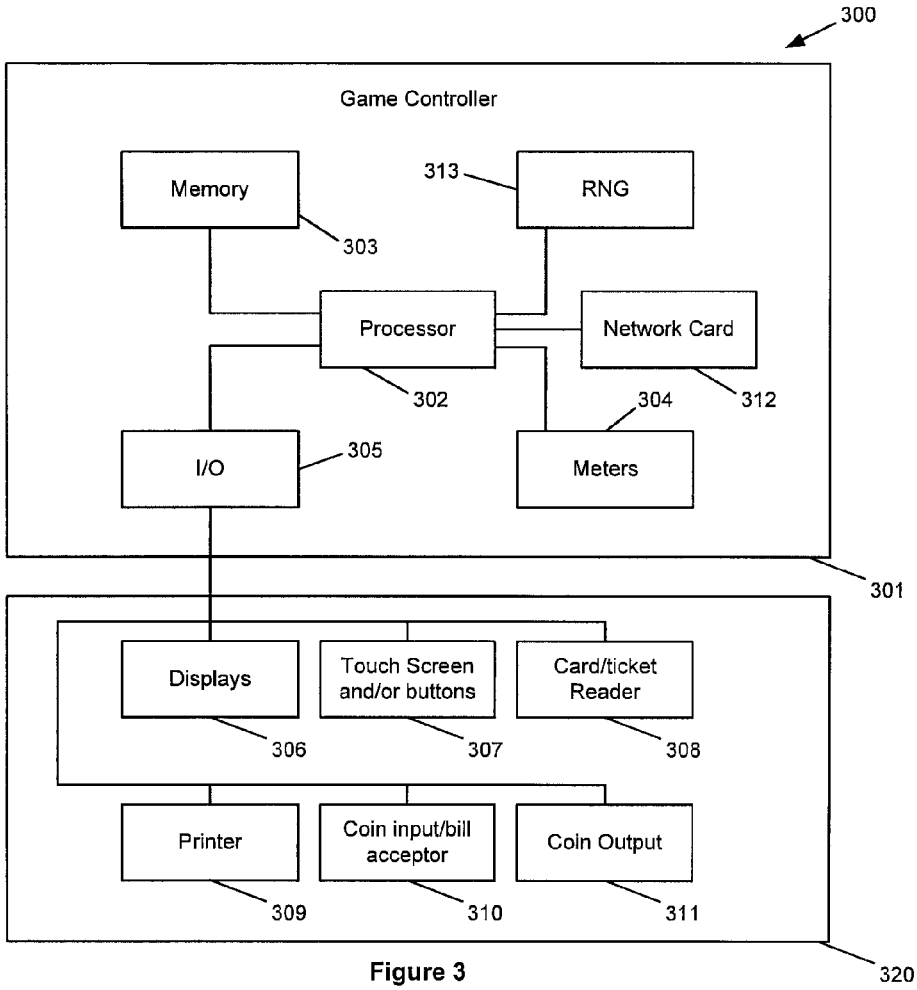
FIG. 3 is a block diagram of the functional components of a gaming machine.

FIG. 3 shows a block diagram of operative components of a typical gaming machine which may be the same as or different to the gaming machine of FIG. 2.

The gaming machine 300 includes a game controller 301 having a processor 302. Instructions and data to control operation of the processor 302 are stored in a memory 303, which is in data communication with the processor 302. Typically, the gaming machine 300 will include both volatile and non-volatile memory and more than one of each type of memory, with such memories being collectively represented by the memory 303.

The gaming machine has hardware meters 304 for purposes including ensuring regulatory compliance and monitoring player credit, an input/output (I/O) interface 305 for communicating with peripheral devices of the gaming machine 300. The input/output interface 305 and/or the peripheral devices may be intelligent devices with their own memory for storing associated instructions and data for use with the input/output interface or the peripheral devices. A random number generator module 313 generates random numbers for use by the processor 302. Persons skilled in the art will appreciate that the reference to random numbers includes pseudo-random numbers.

In the example shown in FIG. 3, a player interface 320 includes peripheral devices that communicate with the game controller 301 including one or more displays 306, a touch screen and/or buttons 307, a card and/or ticket reader 308, a printer 309, a bill acceptor and/or coin input mechanism 310 and a coin output mechanism 311. Additional hardware may be included as part of the gaming machine 300, or hardware may be omitted depending upon the specific implementation.

In addition, the gaming machine 300 may include a communications interface, for example a network card 312. The network card may, for example, send status information, accounting information or other information to a central controller, server or database and receive data or commands from the central controller, server or database.

Figure 4:
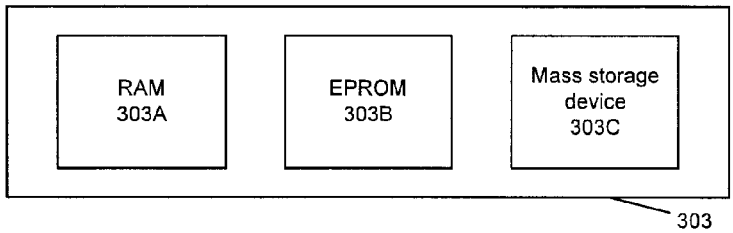
FIG. 4 is a schematic diagram of the functional components of a memory.

FIG. 4 shows a block diagram of the main components of an exemplary memory 303. The memory 303 includes RAM 303A, EPROM 303B and a mass storage device 303C. The RAM 303A typically temporarily holds program files for execution by the processor 302 and related data. The EPROM 303B may be a boot ROM device and/or may contain some system or game related code. The mass storage device 303C is typically used to store game programs, the integrity of which may be verified and/or authenticated by the processor 302 using protected code from the EPROM 303B or elsewhere.

It is also possible for the operative components of the gaming machine 300 to be distributed, for example input/output devices 306, 307, 308, 309, 310, 311 to be provided remotely from the game controller 301.

A gaming device as indicated above may also take the form of a client/server architecture where a portion of the game is executed on the client and a portion of the game is executed on the server. In such embodiments, the client typically takes the form of an interactive video terminal which has a similar outward appearance to the gaming machine described above. A person skilled in the art will appreciate that the type of gaming device that is employed is not important to the present invention.

Group Game Controller

Figure 5:
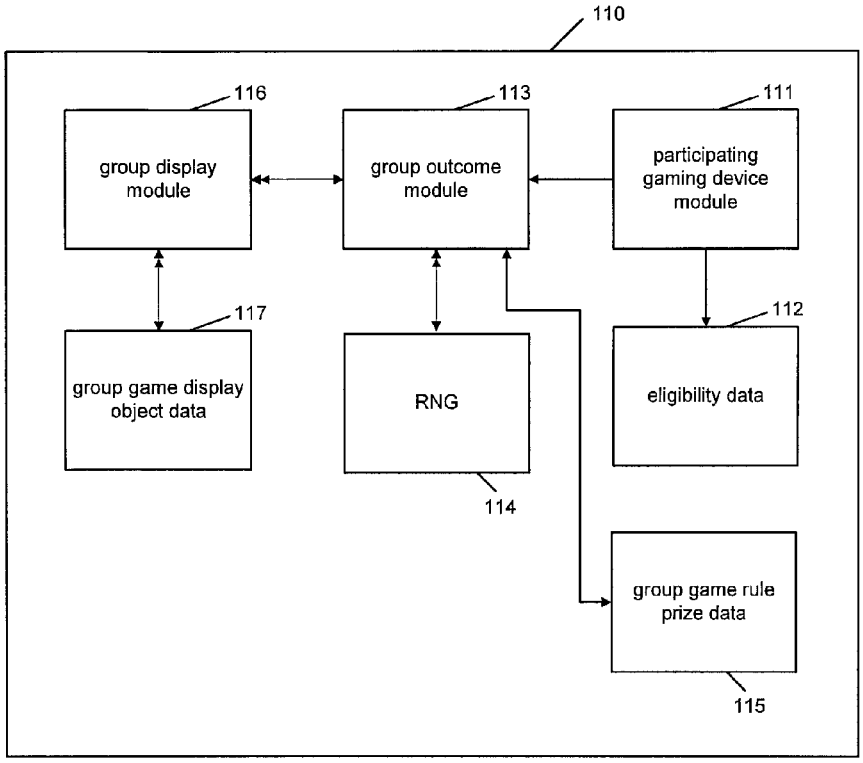
FIG. 5 is a block diagram of a group game controller.

FIG. 5 shows the general configuration of a group game controller 110. A participating gaming device module 111 determines which of the gaming devices are participating in the group game. In a typical group game, this involves the participating gaming device module 111 determining which gaming devices are eligible to participate in the game 112 and subsequently which gaming devices indicate that they will participate in the group game. The participating gaming device module provides data defining the participating gaming machines to the group outcome module 113. The group outcome module 113 determines a group game outcome based on group game rule and prize data 115 and a random number obtained from a random number generator 114. The outcome of the group game may include a winning outcome for one or more of the participating game machines. The group game controller 110 incorporates a group game display module 116 which receives the outcome data from the group outcome module 113 and controls the group game display to display the group game outcome based on the group game outcome and group game display object data 117. Depending on the embodiment, the group game display object data 117 may take different forms. For example, where the group game display is provided by a physical group game display object, such as a vehicle, the group game display object data 117 may define the current position of the vehicle. In other embodiments, the group game display object data 117 may be graphics data which defines the graphical display of the group game display object.

The group game can take a number of different forms and may be decided purely by the group outcome module 113, or by the group outcome module 113 based on input from the gaming devices, or predominantly by outcomes generated by the gaming devices with the group outcome module 113 effectively acting to administrate the group game. However, even in this example, the group game controller will ultimately determine the outcome of the group game as it will perform tasks such as determining which gaming device achieved a winning outcome first. In the last example, the controller 110 does not need the random number generator 114. If the group game outcome is determined by the group outcome module 113 it may involve some input from players of the gaming devices. For example, players may be offered choices in the group game which affect the outcome.

Figure 7:
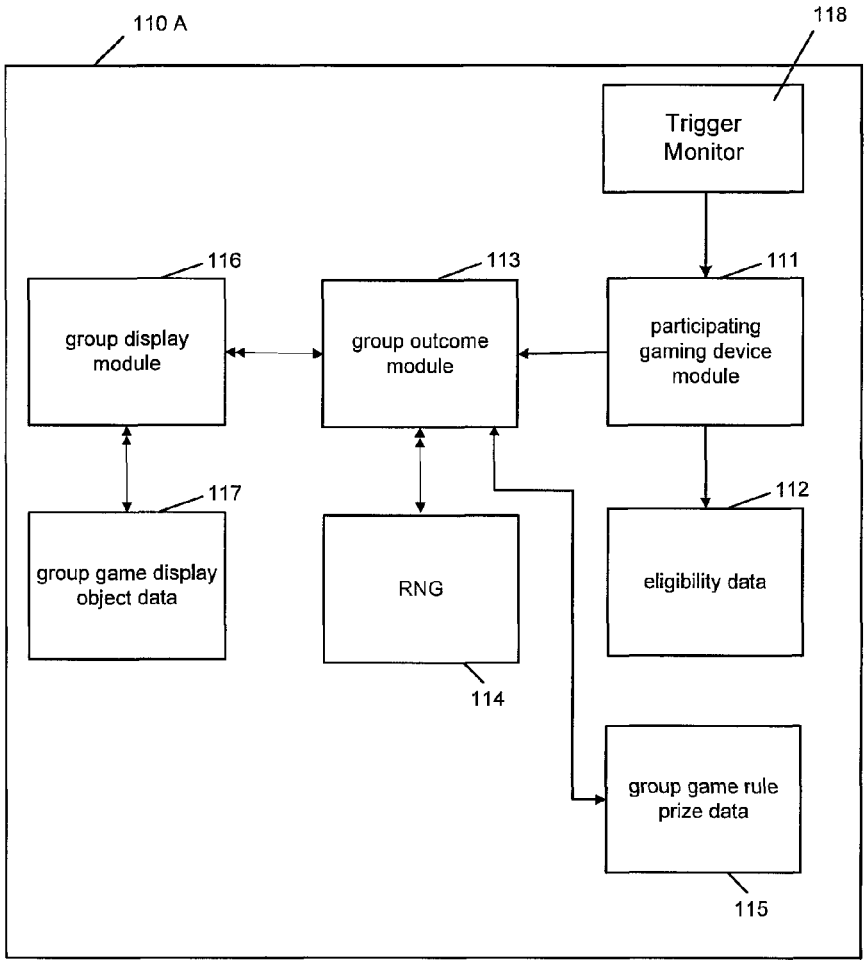
FIG. 7 is a block diagram of another group game controller.

In one advantageous embodiment, the group game controller is implemented on an existing jackpot controller 110A as the group game will typically be employed to award jackpots. In this respect it will be appreciated that in such embodiments, as in existing jackpot controllers, the gaming devices may determine whether the jackpot is to be awarded and the level of jackpot to be awarded and the jackpot controller 110A may be arranged to implement the outcome of the triggering, such that, for example, the outcome module 113 may only determine how the jackpot is distributed rather than the actual outcome of the game as described above. To this end, the controller 110 is modified as indicated in FIG. 7 to incorporate a trigger monitor 118 to monitor and process the triggers and the current values of the jackpots are stored as prize data 115.

Video Display Embodiments

As indicated above, video display embodiments can take the form of either a common display or displays, for example one large circular screen with many gaming devices underneath or one large screen above a bank of machines, or individual displays associated with individual gaming machines such as a top box display, a main display or the display of a player tracking module.

Players become eligible to participate in the group game in accordance with techniques known in the art. For example, it may be sufficient for one player of a bank of machines to become eligible for the group game to be made available to all players. Typically, all gaming devices are stopped at an appropriate moment such as the conclusion of a game round and players are asked whether they wish to participate in the group games. Depending on the embodiment a player's participation of the group game may require them to place an additional bet. The group game begins and game controller 110 controls the display to start moving the display object.

In one embodiment, the display object is a vehicle such as a train having at least one item of rolling stock, for example a locomotive and a number of carriages and freight cars. The train moves in a pattern relative to the gaming machines, for example as if the gaming machines were connected on a track and prizes are awarded if a whole locomotive or carriage is shown on the gaming machine when the train stops. The number of items of rolling stock may be varied based on the game outcome.

In some embodiments, alternate display elements such as terrain elements, such as railway crossings, tunnels, mountains or the like may be used to instead of display of the train or in order to obscure the train on at least one display. This can be used to indicate ineligibility for a prize. For example, rather than displaying the train, a tunnel can be displayed instead. Typically at least one prize is awarded and hence the group game display module 116 controls the stop position of the train so that a locomotive and or a train as displayed on at least one display. Any prize associated with the locomotive of carriage is then provided to the player. An advantage of using a train as the display object is that:

1. A plurality of sub-objects (locomotive, carriages, freight cars) may be displayed on separate machines, thus allowing more than one prize to be awarded concurrently when the train is stopped; and
2. There may be a break between the front of the train defined by the locomotive and the rear of the train, thus one or more neighbouring gaming devices may be shown to miss an award by not having a carriage stopping at their gaming device when the gaming devices are located next to one another.

Other display objects may be used, for example, a snake having a number of segments, a carousel where the horses rotate around the carousel and move up and down such that only horses which are down will result in the award of a prize. In a carousel embodiment, the horses are obscured by moving out of shot and replaced by a background view of the carousel.

The display object may move in a number of directions, for example, forwards, backwards. Further, a track configuration, for example a figure of 8 can be mapped to the plurality of gaming machines so that one or two or more positions on the track correspond to each gaming machine.

Physical Embodiment

Figure 8:
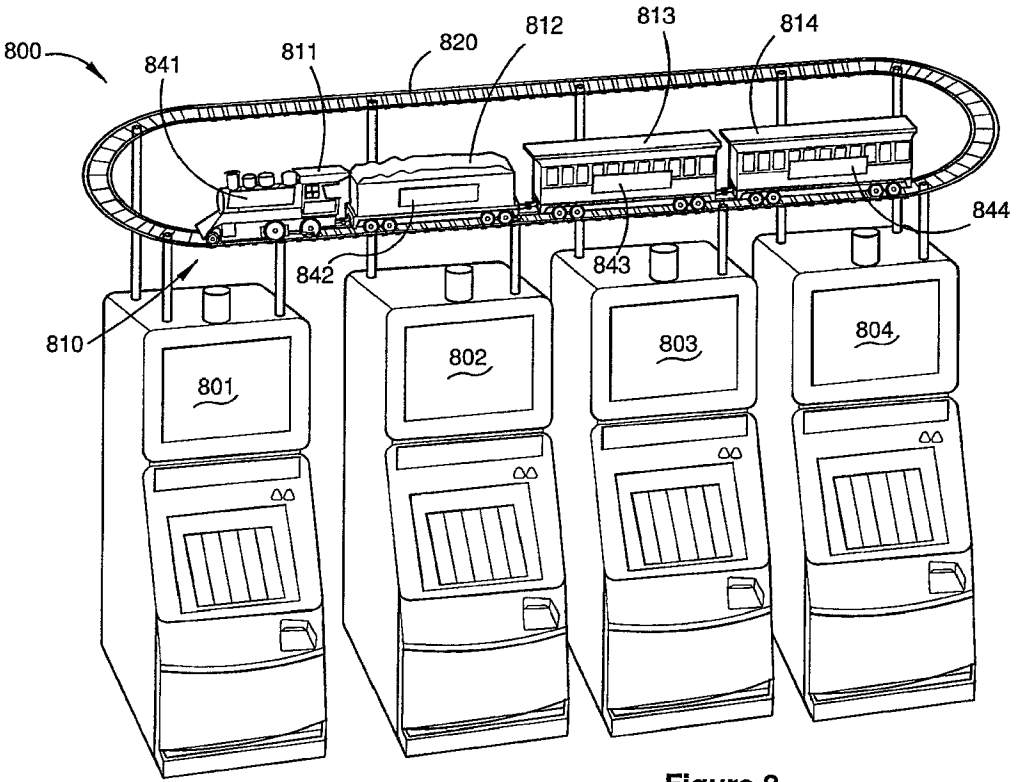
FIG. 8 is a perspective view of an exemplary physical group game display.

An exemplary group game display 800 of a physical embodiment is shown in FIG. 8 and takes the form of a train 810 having a locomotive 811, a tender 812 and two carriages 813, 804 on a track 820 positioned above to the top of a bank of gaming machines 801-804 such that it moves on a path relative to the gaming machines. In the embodiment, the train 810 moves around the track. As described in the video embodiments, the train can stop with an item of rolling stock 811-814 at one or more of the gaming machines 801-804. Again, because the train 810 has a gap between the locomotive 811 and the last carriage 814, it is possible for one or more gaming devices to be left out of the prize awarding. In FIG. 8, each item of rolling stock of the train carries a small LCD display 841-843 which can be used to display the prize outcome. In another embodiment, a number of different trains of different numbers of rolling stock may form part of the display so that different trains can be used depending on the game outcome or number of participating players.

A person skilled in the art will appreciate that other physical objects can be used, For example a horse drawn coach where the horses provide one sub-object and the coach provides another sub object Other objects may also be used in a physical embodiment, for example a snake having a plurality of segments.

A person skilled in the art will appreciate the various modifications may be made without departing from the scope of the invention. For example, in the video embodiments, other objects may be able to be moved within the image. For example, people/seats could be moved to stop at a station or a carriage.

Persons skilled in the art will also appreciate that the method of some of the embodiments could be embodied in program code. The program code could be supplied in a number of ways, for example on a computer readable medium, such as a disc or a memory (for example, that could replace part of memory 103) or as a data signal (for example, by downloading it from a server).

EXAMPLES

Example 1

Figure 6:
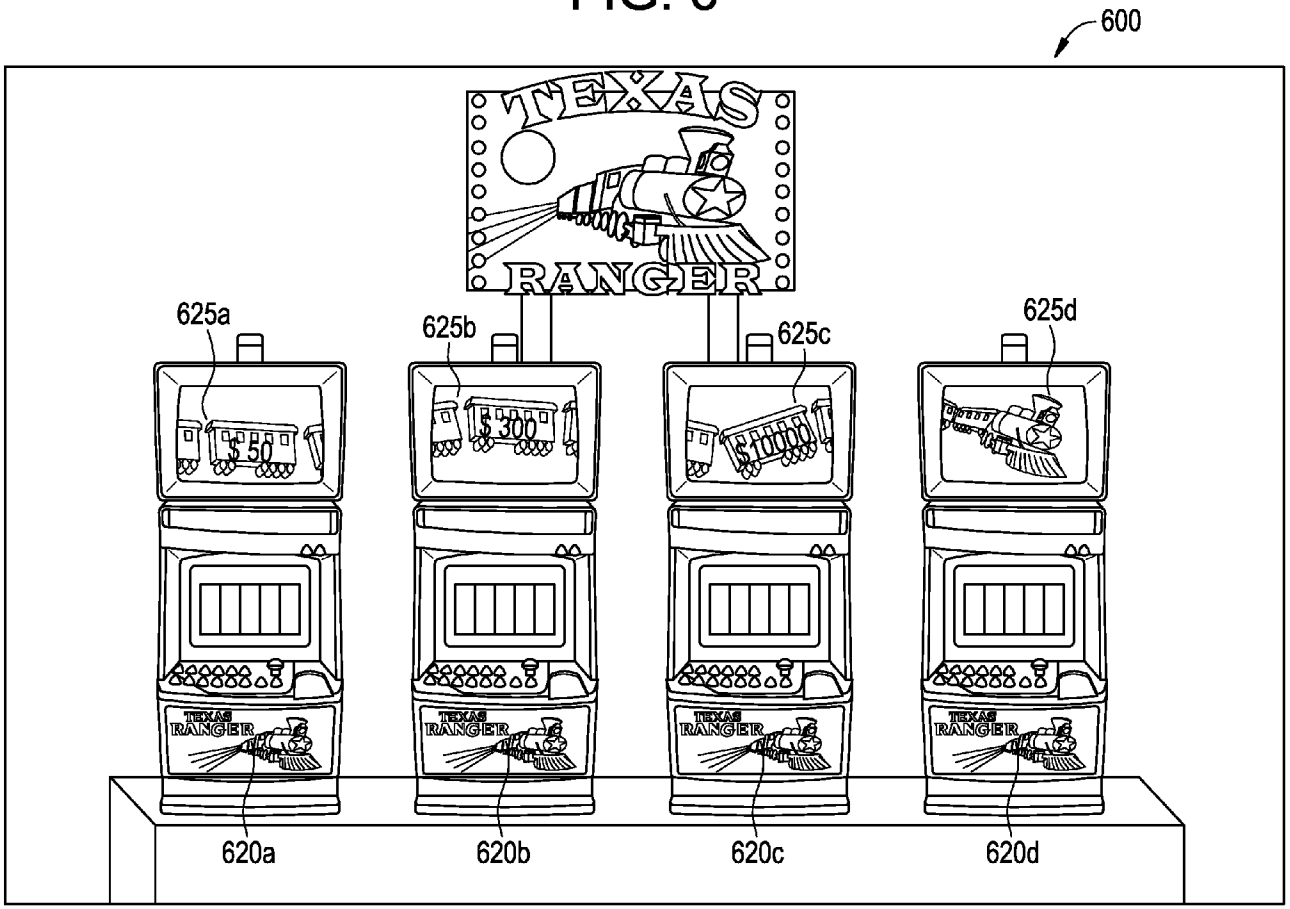
FIG. 6 shows four gaming machines, where the top boxes provide a group game display.

As shown in FIG. 6 a video image of a train moves from top box to top box, 625*a* to 625*d*, on a bank of machines 620*a* to 620*d*. The train has a number of carriages or freight cars and one carriage or freight car or engine is shown on each machine in FIG. 6.

The carriages on the train display various prize levels such as 1st class (jackpot 1), 2nd class jackpot 2), prize values, multipliers, free games, bonus prizes etc. The carriages might display a class of game eg $ machine.

The engine of the train can have a special prize. There may be more than one engine. In the example, a freight car does not display a prize but if a freight car stops on a machine, the freight is unloaded to the machine (a mystery win). Alternatively, the freight car can be loaded with water, fuel, money, etc.

The train moves around the bank of machines and when the train stops, the carriage stopped on the player's machine determines the prize awarded to the player. It is possible that a machine does not have a carriage stopped on it because there is a break between the engine and the end of the train.

The movement of the train can be a continuous movement in one direction, or can move backwards or can move at changing speeds—eg. the train can shunt backwards. The direction and speed can be determined by the RNG 114 following a probability table. The movement of the train can be up and down hills. In such embodiments, the game outcome can be determined by determining characteristics of movement and stopping of the gaming machine.

The speed of the train can affect the jackpots—eg. the faster the train the higher the jackpots. Players may have to guess what tunnel from which the train will emerge. Players may bet on where certain carriages stop.

The visibility of the train can vary eg the train can go into tunnels and re-emerge from tunnels. The train can be "stopped" and inactive for a period of time, and then can recommence its travels.

The player on a machine places a bet and plays the regular game on the machine. The reels on the machine spin and the player is paid a prize (if applicable). The top box on the machine shows the name of the game.

A sound is heard "All Aboard" and the screens in the top boxes on the bank of machines changes to show a train with a number of carriages shown above each machine. Players are asked if they would like to "buy a ticket" for the train to participate in the group game. They can purchase a ticket by placing a special bet on the machine. They may buy any class of ticket and for more than one person and the distance (jackpot level) and destination and return trip.

The trip can happen over say 30 seconds while players continue to play the base game or during the 30 seconds the top and bottom games interact.

Players who do not purchase tickets on the train have the top box "greyed" out to indicate that the train cannot stop at their machine or have a terrain element such as a tunnel displayed.

After a small time delay, the train sets off moving from screen to screen with appropriate sounds.

The train slows down and starts to come to a halt and then shunts backwards and stops with one carriage or engine or freight car at each machine.

The prize shown on the carriage is paid to the player if the player has purchased a "ticket". Once the prizes are paid, the machine top boxes return to a display of game names.

Example 2

In this example, players of a group of gaming machines can choose whether to participate in a "Texas Ranger" progressive jackpot. The gaming machines (EGMs) are of the type having two displays, one which displays a game screen which displays play of a base game (or games) offered on the gaming machine and a second display or top screen arranged above the normal display and used for the Texas Ranger progressive jackpot. The gaming machines are arranged in a bank next to one another from which a communal display also used in the Texas Ranger progressive jackpot can be viewed. In this example, one of four different jackpots may be awarded, and except for in the case of the lowest jackpot, more than one gaming machine is awarded a portion of the jackpot.

A Texas Ranger icon is permanently displayed in the top right hand corner of the game screen which will have a highlighted format ("Now eligible for TEXAS RANGER") and a dull format ("NOT eligible for TEXAS RANGER");

The top screen displays the Texas Ranger banner and the meters for the four levels of progressive jackpot.

Each gaming machine has provision for the player to make a dedicated jackpot ante bet (for example, 50c) that the player can choose to bet in addition to their base game bet. This bet is completely independent of the base game and is not be multiplied by the amount bet per line or per reel on the base game. Hence there will be two separate play buttons that will initiate a game—one which includes the Texas Ranger bet (labelled PLAY REEL GAME+TEXAS RANGER) and one which does not (labelled PLAY REEL GAME).

After the player, selects a bet per line and a number of pay lines, the messages "Press PLAY REEL GAME+TEXAS RANGER to start a game eligible for TEXAS RANGER" appear followed by "OR, Press PLAY REEL GAME to start a game without TEXAS RANGER" rotating above the reels.

The "Now eligible for TEXAS RANGER" icon in the top right band corner of the screen will revert to the dull, "NOT eligible for TEXAS RANGER" state (if not already) but will only do so when the EGM becomes ineligible—in this example, 10 seconds after completion of a game that includes the jackpot ante bet (explained in detail below). Once the EGM becomes ineligible for TEXAS RANGER it will remain ineligible until the next bet is made that includes the jackpot ante bet (hence the icon remains in the dull state).

At the same time that the "Now eligible for TEXAS RANGER" icon reverts to its dull state, a "NOT ELIGIBLE" railway crossing sign will appear over the top screen display and it will remain displayed while the icon remains in its dull state.

If a train carriage with prize amount happens to stop on the top screen of this machine during a TEXAS RANGER feature triggered by another EGM while this EGM is not eligible, the train carriage will be covered by the NOT ELIGIBLE sign and the amount shown on the carriage will be returned to the relevant jackpot pool to be re-distributed during the next feature event (see below).

When the PLAY REEL GAME button is pressed to initiate a game the following occurs:

The PLAY REEL GAME button will remain lit until the next time a PLAY button is pressed to start a game.

The PLAY REEL GAME+TEXAS RANGER bash button (i.e. #8 above) will become unlit (if not already) and will remain that way until the next time a PLAY button is pressed to start a game.

The "Now eligible for TEXAS RANGER" icon in the top right hand corner of the game screen will revert to the dull, "NOT eligible for TEXAS RANGER" state (if not already).

The "NOT ELIGIBLE" railway crossing sign will cover the top screen display (if not already).

A standard base game will play according to the bet per line and number of paylines selection that has previously been made. During this game the player will not be eligible to win anything from the Texas Ranger feature. If a Texas Ranger feature is triggered the NOT ELIGIBLE crossing sign will remain in place on the top screen while relevant train animations (see below) pass underneath the sign.

If a train carriage with prize amount happens to stop on the top screen of this machine during a TEXAS RANGER feature triggered by another EGM while this EGM is not eligible, the train carriage will be covered by the NOT ELIGIBLE sign and the amount shown on the carriage will be returned to the relevant jackpot pool to be re-distributed during the next feature event (see below).

When the PLAY REEL GAME+TEXAS RANGER button is pressed to initiate a game the following occurs:

The PLAY REEL GAME+TEXAS RANGER bash button will remain lit until the next time a PLAY button is pressed to start a game.

The PLAY REEL GAME button will become unlit (if not already) and will remain that way until the next time a PLAY button is pressed to start a game.

The "NOT eligible for TEXAS RANGER" icon in the top right band corner of the game screen will revert to the highlighted, "Now eligible for TEXAS RANGER" state (if not already) and will remain in that state until 10 seconds after the base game completes (see above).

The "NOT ELIGIBLE" railway crossing sign will be removed from the top screen display (if not already).

The jackpot ante bet (in this example, 50c) will be decremented from the credit meter in addition to the standard base game bet. When this happens a percentage of the jackpot ante bet only (i.e. not the base game bet) that is roughly equivalent to the RTP % of the base game will be incremented onto the progressive meters. For the initial release, this will be 90%. Hence, for every game played with the jackpot ante bet and regardless of the size of the base game bet, 50c will be decremented from the credit meter in addition to the base game bet and exactly 45c will be distributed to the different jackpot levels. Refer to the relevant combination sheet for the appropriate jackpot ante bet size and the increment/distribution percentages for each of the jackpot levels.

A standard base game will play according to the bet per line and number of pay lines selection that has previously been made using the onscreen touch buttons.

A random number selection is made by the EGM to determine whether the Texas Ranger progressive feature is to be triggered (see below).

Even if the progressive feature was not triggered by the jackpot ante bet for this game, the player will still be eligible to win a portion of a progressive jackpot from a feature triggered by one of the other EGMs in close proximity to this EGM while the base game is in session and for 10 seconds after the game completes (see below).

Feature Trigger, Eligibility & Distribution

In this example, in order to simplify the controller requirements in this example, the EGMs determine whether the progressive jackpot triggers. Alternatively, the controller could make the determinations based on data communicated to the controller.

When a bet is made that includes the jackpot ante bet, the EGM will determine whether a progressive jackpot has been triggered as follows:

A random number is selected in the range from 1 to the hit rate of the progressive feature (in cents). If the selected number is in the range from 1 to the jackpot ante bet size (in this example 50 cents) then the progressive feature will be triggered.

If the random selection indicates that a progressive feature has been triggered then a further random selection is made to determine which level of progressive has been triggered. The controller 110 will be notified immediately that the Texas Ranger feature has been triggered, and which jackpot level is to be awarded.

When the controller is notified by an EGM that a progressive level has been triggered, the controller 110:

The participating gaming device module 111 determines which EGMs will be eligible to win a portion of the progressive in addition to the triggering machine, Namely, all EGMs that are (currently in game play mode or were in game play mode within the last 10 seconds) AND (the last bet made included the jackpot ante bet) will be eligible to win.

Notifies all EGMs that a progressive feature has been triggered, and whether or not they are eligible. (Note: when an EGM receives this information:

If it is NOT eligible it must ensure that the dull "NOT eligible for TEXAS RANGER" icon is being displayed and the NOT ELIGIBLE railway crossing sign appears on the top screen display immediately cancelling any attract mode sequence that may currently be in progress on the top screen;

If it is eligible it must ensure that the highlighted "Now eligible for TEXAS RANGER" icon is being displayed and display the transparent TEXAS RANGER banner over the top of the game screen to indicate that the feature is about to commence);

Plays PHASE 1 of the progressive feature (see Texas Ranger Feature below) which involves an animation/sound sequence on the communal display that results in the relevant one of the four jackpot levels being selected;

Freezes the relevant progressive jackpot level and buffer any further progressive jackpot increments to the same jackpot level in a fresh, hidden jackpot pool starting with the start up amount for that jackpot level.

If the triggered jackpot level is anything other (i.e. MINOR, MAJOR or MAX) than the lowest level (i.e. MINI) the group outcome module 113 makes a further random selection to split the jackpot amount into portions. An example of possible splits is shown in Table 1.

To determine the split, the group outcome module 113:

determines the number of portions there will be from the jackpot level;

selects a random number in the range 1 to the number of portions to reflect the split percentage column that will be used: A, B, C or D; and splits the frozen progressive amount into portions according to the weightings in the relevant split percentage column (rounding to whole cents).

TABLE 1

| Progressive level | No. of portions | Split percentages A | B | C | D |
|---|---|---|---|---|---|
| Maxi | 4 | 80%, 10%, 8%, 2% | 60%, 20%, 15%, 5% | 50%, 25%, 15%, 10% | 40%, 30%, 20%, 10% |
| Major | 3 | 80%, 15%, 5% | 60%, 30%, 10% | 50%, 35%, 15% | — |
| Minor | 2 | 80%, 20% | 60%, 40% | — | — |
| Mini | 1 | 100% | — | — | — |

The controller then:

Plays PHASE 2 of the TEXAS RANGER feature (see Texas Ranger Feature below) which involves the jackpot amount being split into portions if applicable.

Changes the communal display to display all 4 jackpot levels incrementing in the 4 corners of the display with the TEXAS RANGER banner animating in the centre. The incrementing jackpot for the progressive level that is currently being played in the Texas Ranger feature will be the buffered hidden jackpot that was reset in above.

Plays PHASE 3 of the TEXAS RANGER feature (see below) which involves a sequence of animations/sounds on the top screens of connected EGMs and results in jackpot portions being displayed on a sequence of 1-4 consecutive EGMs.

After completion of the relevant progressive feature, award the jackpot amounts to the EGMs as follows:

The largest portion goes to the EGM that triggered the progressive feature;

The next largest portion (if applicable) goes to the EGM that is physically located one position to the left of (i.e. immediately left of) the triggering EGM. However if this EGM displays the NOT ELIGIBLE crossing sign then it will NOT be paid to the EGM but will rather be dumped back into the new jackpot pool that is currently incrementing on the overhead display for the relevant jackpot level;

The next largest portion (if applicable) goes to the EGM that is physically located two positions to the left of the triggering EGM. However if this EGM displays the NOT ELIGIBLE crossing sign than it will NOT be paid to the EGM but will rather be dumped back into the new jackpot pool that is currently incrementing on the overhead display for the relevant jackpot level;

The next largest portion (if applicable) goes to the EGM that is physically located three positions to the left of the triggering EGM. However if this EGM displays the NOT ELIGIBLE crossing sign then it will NOT be paid to the EGM but will rather be dumped back into the new jackpot pool that is currently incrementing on the overhead display for the relevant jackpot level.

After completion of the win celebration and win transfer for the progressive feature, the overhead display and EGM top screens will return to their standard idle mode/base game display (including "NOT ELIGIBLE" signs where applicable).

Coinciding Triggers

If any further progressive jackpot features are triggered while the jackpot feature is in progress, The game controller 110:

Buffers the trigger for the relevant jackpot level so that another feature can commence immediately after completion of the current feature;

Determines which EGMs are eligible for the feature and buffer the information so that the correct EGMs are included in the new feature. NOTE: the EGMs that will be eligible will be [all EGMs that are (currently in game play mode or were in game play mode within the last 10 seconds) AND (the last bet made included the jackpot ante bet)] AND [the EGMs currently involved in the progressive feature]. That is, all EGMs that would normally be eligible plus those already in the TEXAS RANGER feature.

Texas Ranger Feature Display

Phase 1 of the Texas Ranger feature display is the selection of the relevant jackpot level as follows:

An animation involving a large Texas Ranger banner being revealed is displayed at the same time on the overhead display and on the top screen of all eligible EGMs. The accompanying sounds will be loud to alert the players that a progressive feature is commencing;

The Texas Ranger banners will remain on the top screen displays of the eligible EGMs and also a large arrow will appear on each top screen pointing upwards with the message "LOOK UP TO THE BIG SCREEN";

At the same time a feature screen will appear on the overhead screen which is space themed and includes 4 prominent planets labelled with the 4 jackpot level names (MINI, MINOR, MAJOR, MA) and the current value of those jackpots (which may still be incrementing);

There are a set of 16 different train animations with applicable sounds each of which show a train starting from the same point and moving gradually around the screen to land on one of the jackpot level planets. There are be 4 different animations for each level and each of the 4 for each level commences in exactly the same way as one of the animations for each of the other levels so that there is some suspense to the player about which jackpot level will be selected. The procedure for the feature animation is:

The controller 110 selects a random number in the range 1 to 4 to represent the animation sequence that will be played.

The set of 4 animations to select from are the 4 that relate to the jackpot level that was triggered by the triggering EGM.

The relevant animation and sounds will play on the communal display resulting in the train landing at the planet that represents the applicable jackpot level.

A celebratory animation and sounds will play that is appropriate for the relevant jackpot level. For example a long, loud and colourful 'song and dance' for the MAXI jackpot including fireworks or similar, but for the MINI jackpot it is really just an acknowledgement of the jackpot level which might include flashing the jackpot amount and a short tune or similar.

Phase 2 of the Texas Ranger feature display is the splitting up of the progressive jackpot as follows:

The overhead screen will change to display a large version of the frozen jackpot level at the top of the screen, with the other 3 jackpot levels continuing to increment but reduced to a small size on the bottom of the screen.

A train whistle will blow and a large train will enter the middle of the screen travelling from left to right. The train will be:

- a standard steam train engine if the MINI jackpot was triggered,
- a standard steam train engine pulling a red caboose if the MINOR jackpot was triggered,
- a gold steam train engine pulling a silver carriage followed by a red caboose if the MAXI jackpot was triggered, or
- a gold steam train engine pulling a silver carriage followed by a bronze carriage and then a red caboose if the MAX Jackpot was triggered.

An animation will show the train being loaded up while a "coin shower" sound plays. The animation will involve the frozen jackpot amount decrementing at the same rate that the amounts on the train increment.

If the MINI jackpot was triggered then the entire amount of the jackpot will increment on to the train engine at the same rate that it decrements from the pool above it.

For the other jackpots, the train engine will increment first while the pool above it decrements until the amount on the engine reaches the amount of the largest jackpot portion. There will then be a slight pause in the animation and "coin shower" sound before the next carriage or caboose increments to the amount of the second jackpot portion and so on for each applicable carriage/caboose.

Phase 3 of the Texas Ranger feature display is the distribution of the progressive jackpot as follows:

A conductor's whistle sound will play and the train on the overhead display will slowly begin to move as if fully loaded. At the same time the top screens of the EGMs will change to a space background, advantageously with subtle star animations. The EGMs that are not eligible will include the NOT ELIGIBLE crossing sign superimposed over the top of the space background.

When the train disappears off the end of the overhead screen it will then enter the screen of the first EGM of the bank. It will gradually pick up momentum moving from top screen to top screen around the entire bank, It will be sized such that each part of the train (i.e. engine, carriage or caboose) will fit exactly to the size of a screen so that when the engine appears completely on the screen of one EGM the next carriage (if applicable) fits completely to the screen of the EGM to its left and so on. On screens that include the NOT ELIGIBLE crossing sign the train will pass underneath the sign so that it is partially obscured from view by the sign.

Once the train has done a complete lap of the bank allowing the players to see the prize amounts go by on their own EGM, the train will commence another lap but this time will start to slow down with a screech of brakes as it approaches the triggering EGM until it stops with the engine completely displayed on the top screen of the triggering EGM. Note that as the train disappears off the end of the bank it starts to appear at the start of the bank such that if, for example, the first EGM on the bank were the triggering machine the engine would stop on the first EGM while the other carriages would remain on the last EGMs of the bank.

It will be understood to persons skilled in the art of the invention that many modifications may be made without departing from the spirit and scope of the invention, in particular it will be apparent that certain features of the above examples and embodiments of the invention can be employed to form further embodiments.

It is to be understood that if any prior art is referred to herein, such reference does not constitute an admission that the prior art forms a part of the common general knowledge in the art in any country.

In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. As noted above, certain embodiments of the present invention may be implemented using an existing computer processor and/or by a special purpose computer processor incorporated for this or another purpose or by a hardwired system, for example.

As noted above, embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Certain embodiments of the invention are described in the general context of method steps which may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A gaming system comprising:

a plurality of gaming devices;

a common physical group game display comprising a an object arranged to travel on a path relative to the plurality of gaming devices, wherein the object is comprised of a plurality of sub-objects; and a group game controller in data communication with the plurality of gaming devices and the group game display, the group game controller including a processor configured to:

determine a game outcome of a group game;

control movement of the object relative to the plurality of gaming devices based on the game outcome; and stopping the object on the path in a random manner such that the plurality of sub-objects each align with respective ones of the plurality of gaming devices, each sub-object comprising indicia that is indicative of a prize awardable to a respective player of the gaming device that is aligned with that sub-object, wherein the object is a train comprising at least one item of rolling stock and the position of at least one item of rolling stock indicates the game outcome, wherein there are a plurality of items of rolling stock and the front of the first item of rolling stock and the rear of the item of rolling stock are separated from one another by a gap corresponding to a width of at least one gaming device, such that the train is not continuous.

2. A gaming system as claimed in claim 1, wherein the group game controller controls a stopping position of the object based on the game outcome.

3. A gaming system as claimed in claim 2, wherein the stopping position of at least a portion of the object relative to one or more of the gaming devices indicates the game outcome.

4. A gaming system as claimed in claim 2, wherein the group game controller determines a game outcome at least in part by determining a stopping position for the object.

5. A gaming system as claimed in claim 1, wherein the group game controller determines a participation in the group game of each of the plurality of gaming devices, and controls movement of the object based on the determined participation.

6. A gaming system as claimed in claim 1, wherein where the game outcome involves the award of a prize to a participating gaming device and at least one item of rolling stock is stopped at a prize indicating position relative to the gaming device.

7. A gaming system as claimed in claim 1 further comprising track on which the train runs.

8. A gaming system as claimed in claim 1, wherein at least a portion of the object carries a display for displaying a prize amount.

9. A gaming system as claimed in claim 1, wherein the group game controller determines a group game outcome at least partly based on data received from one of the gaming devices indicating at least that the gaming device is entitled to win the group game.

10. A group game controller in data communication with a plurality of gaming devices and a physical group game display comprising an object arranged to travel on a path relative to the plurality of gaming devices, wherein the object is comprised of a plurality of sub-objects, the group game controller including a processor configured to:

determine an outcome of a group game;

control movement of the object relative to the plurality of gaming devices based on the group game outcome; and stop the object on the path in a random manner such that the plurality of sub-objects each align with respective ones of the plurality of gaming devices, each sub-object comprising indicia that is indicative of a prize awardable to a respective player of the gaming device that is aligned with that sub-object, wherein the object is a train comprising at least one item of rolling stock and the position of at least one item of rolling stock indicates the game outcome, wherein there are a plurality of items of rolling stock and the front of the first item of rolling stock and the rear of the item of rolling stock are separated from one another by a gap corresponding to a width of at least one gaming device, such that the train is not continuous.

11. A group game controller as claimed in claim 10, configured to control a stopping position of the object based on the game outcome.

12. A group game controller as claimed in claim 10, arranged to determine a participation in the group game of each of the plurality of gaming devices, and controls movement of the object based on the determined participation.

13. A group game controller as claimed in claim 10, arranged to determine a game outcome at least in part by determining a stopping position for the object.

14. A group game controller as claimed in claim 10, arranged to determine a group game outcome at least partly based on data received from one of the gaming devices indicating at least that the gaming device is entitled to win the group game.

15. A method of displaying an outcome of a group game comprising:

providing a common physical group game display comprising an object arranged to travel on a path relative to the plurality of gaming devices, wherein the object is comprised of a plurality of sub-objects;

determining, using a processor, an outcome of a group game;

controlling movement of the object relative to the plurality of gaming devices based on the group game outcome; and stopping the object on the path in a random manner such that the plurality of sub-objects each align with respective ones of the plurality of gaming devices, each sub-object comprising indicia that is indicative of a prize awardable to a respective player of the gaming device that is aligned with that sub-object, wherein the object is a train comprising at least one item of rolling stock and the position of at least one item of rolling stock indicates the game outcome, wherein there are a plurality of items of rolling stock and the front of the first item of rolling stock and the rear of the item of rolling stock are separated from one another by a gap corresponding to a width of at least one gaming device, such that the train is not continuous.

16. A method as claimed in claim 15, comprising controlling a stopping position of the object based on the game outcome.

17. A method as claimed in claim 16, comprising indicating the game outcome by the stopping position of at least a portion of the object relative to one or more of the gaming devices.

18. A method as claimed in claim 16, comprising determining a game outcome at least in part by determining a stopping position for the object.

19. A method as claimed in claim 16, comprising determining a group game outcome at least partly based on data received from one of the gaming devices indicating at least that the gaming device is entitled to win the group game.

20. A method as claimed in claim 15, comprising determining a participation in the group game of each of the plurality of gaming devices, and controlling movement of the object based on the determined participation.

21. A group game display for a gaming system comprising a plurality of gaming devices, the group game display comprising a controllable object physically moveable along a path relative to the plurality of gaming devices to indicate a group game outcome, the object comprising a plurality of sub-objects, wherein movement of the object is to stop in a random manner such that the plurality of sub-objects each align with respective ones of the plurality of gaming devices, each sub-object comprising indicia that is indicative of a prize awardable to a respective player of the gaming device that is aligned with that sub-object, wherein the object is a train comprising at least one item of rolling stock and the position of at least one item of rolling stock indicates the game outcome, wherein there are a plurality of items of rolling stock and the front of the first item of rolling stock and the rear of the item of rolling stock are separated from one another by a gap corresponding to a width of at least one gaming device, such that the train is not continuous.

22. A group game display as claimed in claim 21 further comprising track on which the train runs.

23. A group game display as claimed in claim 21, wherein at least a portion of the object carries a display for displaying a prize amount.

* * * * *